US009222313B2

(12) United States Patent
Vatne

(10) Patent No.: US 9,222,313 B2
(45) Date of Patent: Dec. 29, 2015

(54) ARRANGEMENT IN A HOSE CONNECTION BETWEEN A WELLHEAD AND A SURFACE INSTALLATION

(71) Applicant: Per A. Vatne, Kristiansand (NO)

(72) Inventor: Per A. Vatne, Kristiansand (NO)

( * ) Notice: Subject to any disclaimer, the term of this patent is extended or adjusted under 35 U.S.C. 154(b) by 0 days.

(21) Appl. No.: 13/964,379

(22) Filed: Aug. 12, 2013

(65) Prior Publication Data

US 2014/0166299 A1 Jun. 19, 2014

Related U.S. Application Data

(63) Continuation of application No. 12/989,915, filed as application No. PCT/NO2009/000159 on Apr. 27, 2009, now Pat. No. 8,505,980.

(30) Foreign Application Priority Data

Apr. 30, 2008 (NO) ..... 20082032

(51) Int. Cl.

| | |
|---|---|
| ***F16L 39/00*** | (2006.01) |
| ***E21B 17/02*** | (2006.01) |
| ***E21B 17/01*** | (2006.01) |
| ***E21B 17/10*** | (2006.01) |

(52) U.S. Cl.
CPC ..... *E21B 17/02* (2013.01); *E21B 17/01* (2013.01); *E21B 17/1035* (2013.01)

(58) Field of Classification Search
USPC ..... 285/18, 19, 401, 360, 362, 920, 27
See application file for complete search history.

(56) References Cited

U.S. PATENT DOCUMENTS

| | | | | |
|---|---|---|---|---|
| 3,517,738 | A * | 6/1970 | Petersen | 166/349 |
| 3,747,632 | A | 7/1973 | Kok et al. | |
| 3,888,318 | A * | 6/1975 | Brown | 173/149 |
| 3,948,545 | A | 4/1976 | Bonds | |
| 4,226,447 | A * | 10/1980 | Brown | 285/316 |
| 4,280,719 | A * | 7/1981 | Daniel et al. | 285/90 |
| 4,408,929 | A | 10/1983 | Baugh | |
| 4,489,959 | A * | 12/1984 | Satterwhite | 285/18 |
| 4,630,847 | A * | 12/1986 | Blenkush | 285/29 |
| 7,040,393 | B2 * | 5/2006 | Adams et al. | 166/77.51 |
| 7,163,054 | B2 * | 1/2007 | Adams | 166/75.13 |
| 7,316,430 | B2 * | 1/2008 | Biester | 285/394 |
| 7,703,812 | B2 * | 4/2010 | Asam et al. | 285/38 |
| 8,505,980 | B2 | 8/2013 | Vatne | |

FOREIGN PATENT DOCUMENTS

| | | |
|---|---|---|
| FR | 2084606 | 12/1971 |
| FR | 2526517 | 11/1983 |
| GB | 1540503 | 2/1979 |

* cited by examiner

*Primary Examiner* — Aaron Dunwoody
(74) *Attorney, Agent, or Firm* — Eubanks PLLC

(57) ABSTRACT

Arrangement in a hose connector of a riser provided between a wellhead and a floating surface installation. One or more hoses form a flexible fluid communicating connection between an upper portion of the riser and the floating surface installation. The first end portion of at least one fluid conduit is fixed to the riser by an upwardly directed, first pipe muzzle and is provided with a rotatable connecting sleeve. Each of one or more flexible hoses is connected to a conduit spool of a connecting assembly provided with a second and pipe muzzle that is arranged for releasable mating with the first end portion of the fluid conduit. A lifting yoke is connected to the connecting assembly and forms an actuator which is able to effect rotary motion to the connecting sleeve to enable engagement.

8 Claims, 4 Drawing Sheets

ARRANGEMENT IN A HOSE CONNECTION BETWEEN A WELLHEAD AND A SURFACE INSTALLATION

BACKGROUND

The invention relates to an arrangement in a hose connection on a riser provided between a wellhead and a floating surface installation, in particular a connecting means arranged between fluid pipes on the riser and flexible hoses that connect the fluid hoses with the surface installation. The invention includes rotatable connecting sleeves arranged on the pipes on the riser and a connecting assembly connected to the flexible hoses and provided with an actuator arranged for rotation of the connecting sleeve during connection and disconnection.

Between a floating exploration and/or production unit (in the following, for convenience, termed "production unit"), for example a rig, and a subsea hydrocarbon well, a number of pipe connections extend, for example fluid transferring hoses, which are vital for the control of the well. The pipes extend through the so called riser which is secured to the well head and is connected to the movable production unit via a telescopic connection. At the entrance of the riser the pipes are provided with a connector which enables disconnection of the pipe connection between the production unit and the riser.

The pipe connections are of significant importance for the control of the blowout preventer (BOP), for example, the drilling mud transportation return and the hydraulic operation of the well installations. On modern, large production units, these pipe connections have large dimensions, for example are pipes having 100 mm inner diameter and dimensioned for 1000 bar pressure, not unusual, and total weight of the unit which is connected to the riser can exceed 10 tons. Each hose connector needs to be locked individually and resist huge forces, over 100 tons each in hydraulic connecting force is not unusual.

In operative state the hose connectors are located in an area where they are heavily exposed to wave splash, and this entails substantial risk for malfunctions in the connectors.

Connection or disconnection involves great efforts by a substantial number of persons who in some extent need to carry out highly hazardous operations from improvised working decks, suspending in straps over open sea having structures in motion due to waves and wind.

SUMMARY

The invention relates to an arrangement in a hose connector on a riser provided between a wellhead and a floating surface installation, where one or more hoses provides a flexible, fluid communicating connection between an upper portion of the riser and the floating surface installation, distinguished in that a first end part of at least one fluid pipe is secured to the riser by a first upwardly directed pipe muzzle and provided with a rotatable connecting sleeve; each of one or more flexible hoses are connected to the pipe spool of a connecting assembly provided with a second pipe muzzle which is arranged for releasable connection with the first end part of the fluid pipe; a lifting yoke is connected to the connecting assembly in such a way that the lifting yoke can be displaced vertically relative to the connecting assembly and forms an actuator which by the vertical motion of the lifting yoke relative to the connecting assembly is arranged to be able to introduce a rotary motion to the connecting sleeve, said actuator being in engagement with at least one connecting sleeve.

The actuator may include an element provided with a guide groove which is inclined relative to the central axis of the connecting sleeve. A first connecting sleeve can be provided with a guide pin arranged for sliding movement in the longitudinal direction of the guide groove by the vertical movement of the lifting yoke relative to the connecting assembly. The guide pin can by the inclination of the guide groove and the longitudinal extension thereof be arranged to enable a rotational movement on the first connecting sleeve from an open and to a locked position relative to the pipe spool of the connecting assembly. The rotational movement of the connecting sleeve may constitute a sector of $360°/n \pm 2°$, where n is an even number and can be 16.

The first connecting sleeve can be connected to adjacent second and third connecting sleeves by means of transmission means arranged for simultaneous and synchronised rotational motion of several connecting sleeves. The transmission means can be formed of one or more parts projecting radially outward from each of the connecting sleeves and interconnected by means of articulated joints and possibly an intermediate linkage. The connecting sleeves may be provided with means for sliding, axial guiding of the end part of the pipe spools and with means for axial fixation of the pipe spools within the connecting sleeve.

The connecting sleeve can internally be provided with several axially directed guiding grooves, where intermediate, radially inward directed guiding ridges in a portion located remote from the muzzle of the fluid pipe, exhibit a lesser height than an adjacent portion located close to the muzzle of the fluid pipe, an arresting surface being formed in each guiding ridge. The end part of the pipe spool can have an external form complementary to the internal shape of the connecting sleeve, where more abutment surfaces formed in the guiding ridges are arranged to abut against each respective arresting surface when the pipe spool is introduced into the connecting sleeve and the connecting sleeve by rotation is moved toward its one extreme positions.

The riser may be provided with several guide pins arranged to be in engagement with guiding surfaces in the connecting assembly.

The lifting yoke can be connected to the connecting assembly by means of at least one sliding guide including an end stop.

BRIEF DESCRIPTION OF THE DRAWINGS

In the following an example of a preferred embodiment is described, which is illustrated in the appended drawings, where.

DETAILED DESCRIPTION OF SPECIFIC EMBODIMENTS

Figure 1:
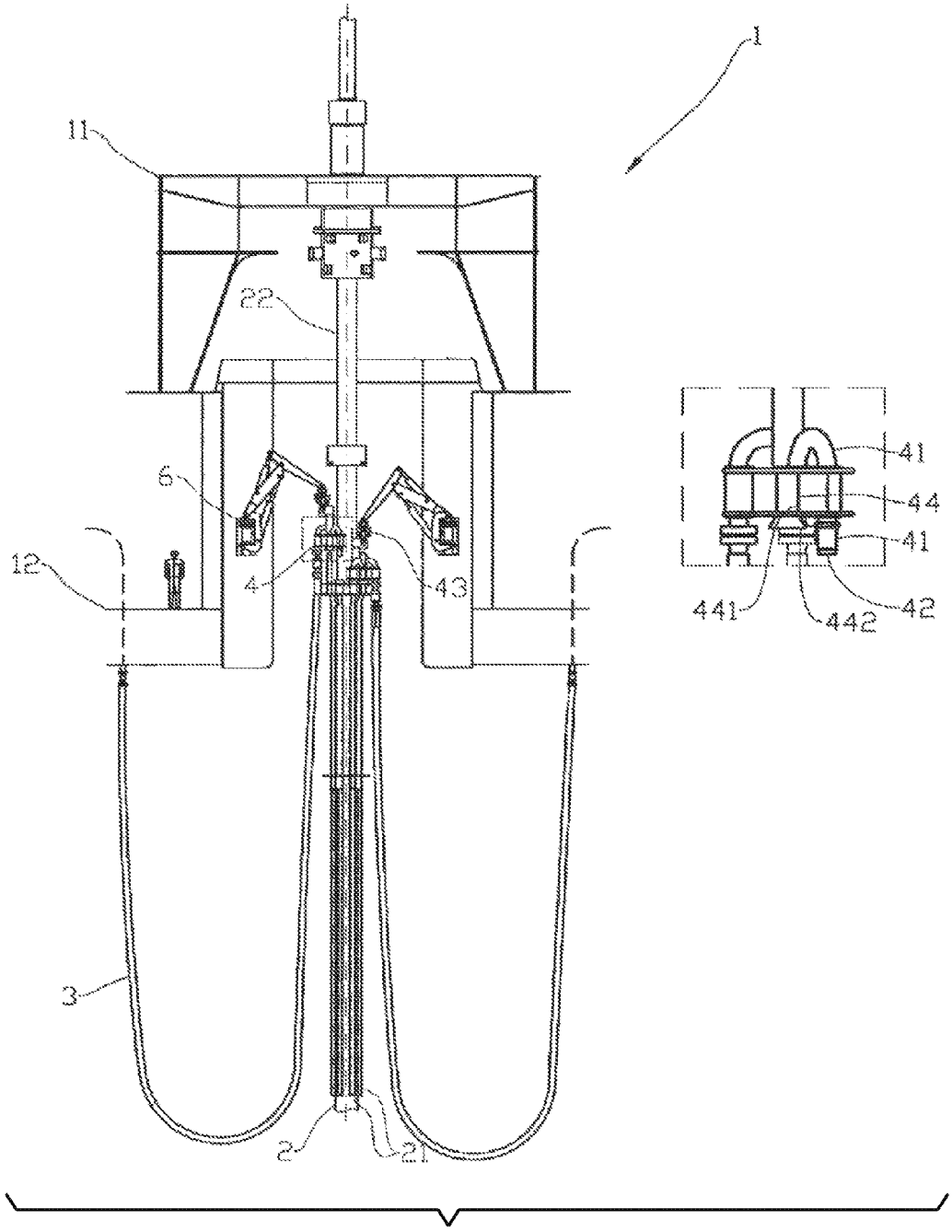
FIG. 1 shows schematically an elevational view of an arrangement for a floating surface installation where an arrangement according to the invention is associated with the riser.

A portion of a floating installation is denoted by the reference number 1. The floating installation 1 includes a drill floor 11 and a cellar deck 12 where a riser 2, extending in a per se known manner from a sea bed installation (not shown), for example a wellhead, is interconnected with the floating installation 1 by means of a telescopic unit 22 and heave compensators (not shown) according to known technology. Along the riser 2, a number of fluid pipes 21 are arranged for transportation of fluids back and forth from the well head, and are interconnected via flexible hoses 3 to the floating installation 1.

Several hoses 3, here shown three, are connected to a common connecting assembly 4 which is provided with a number of pipe spools 41 which in a first end are provided with hose connectors 411 for depending connection of the hose 3, and in a second end is provided with pipe muzzle 42 which in the operative position of the connecting assembly 4 faces downwards and toward a pipe muzzle 212 on the fluid pipes 21 where each of the pipe spools 41 exhibit an inverted U-shape.

At least the upper end parts 211 of the fluid pipes 21 are located in groups on the riser 2, each group of fluid pipes 21 being arranged for connection to each respective connecting assembly 4. In FIG. 1, the exemplified embodiment is shown with two connecting assemblies 4. However, for a riser 2 having huge diameter and many fluid pipes 21, it may be convenient to use more connecting assemblies 4.

The upper end parts 211 of the fluid pipes 21 are secured to a frame 23 which projects outwardly from the periphery of the riser 2. The upper end parts 211 of each of the fluid pipes 21 are provided with a connecting sleeve 213*a*, 213*b*, 213*c* which is rotatable supported in its respective fluid pipe 21. The pipe spool 41 is provided with a gasket 424 which is arranged for abutment against an internal surface at the end part 211 of the fluid pipe 21 to create a fluid tight connection when the fluid pipe 21 and the respective pipe spool 41 is connected.

The connecting sleeve 213*a*, 213*b*, 213*c* is internally provided with several axially directed guide grooves 213*g*, where intermediate radially inwards projecting guide ridges 213*h* in a portion located remote from the pipe muzzle 212 of the fluid pipe 21, exhibit a smaller height than in an adjacent part located close to the pipe muzzle 212 of the fluid pipe 21, and an arresting surface 213*i* is provided in each guide ridge 213*h*.

An area of the end part of the pipe spool 41 has an external shape complementary to the internal shape of the connecting sleeve 213*a*, 213*b*, 213*c*, and several guide grooves 421 having intermediate, outwardly extending guide ridges 422 form abutment surfaces 423 which by introduction of a pipe spool 41 into the connecting sleeve 213*a*, 213*b*, 213*c* and subsequent rotation of the connecting sleeve 213*a*, 213*b*, 213*c*, are arranged to rest abutting against the arresting surface 213*i* and thus cause that the pipe spool 41 is kept connected in a fluid tight way with its respective fluid pipe 21. The arresting surface 213*i* forms a slight slanting inclined plane to effect that rotation of the connecting sleeve 213*a*, 213*b*, 213*c* from a position A (open) to position B (locked) moves the pipe spool 41 in axial direction to sealing abutment of the gasket 424 against the fluid pipe 21.

The connecting sleeves 213*a*, respectively 213*b*, 213*c* are provided with two, respectively one, projecting arm(s) 213*e*. The arms 213*e* of the intermediate connecting sleeve 213*a* form together with a bolt 213*f* an articulated joint linked to the arm 213*e* on the second, respectively third connecting sleeve 213*b*, 213*c*, said arm 213*e* on the second and third connecting sleeve 213*b*, 213*c* being provided with an elongated groove (not shown) for receipt of the bolt 213*f*.

The one connecting sleeve 213*a* is provided with a guide pin 213*d* which project radially outwards.

Figure 2:
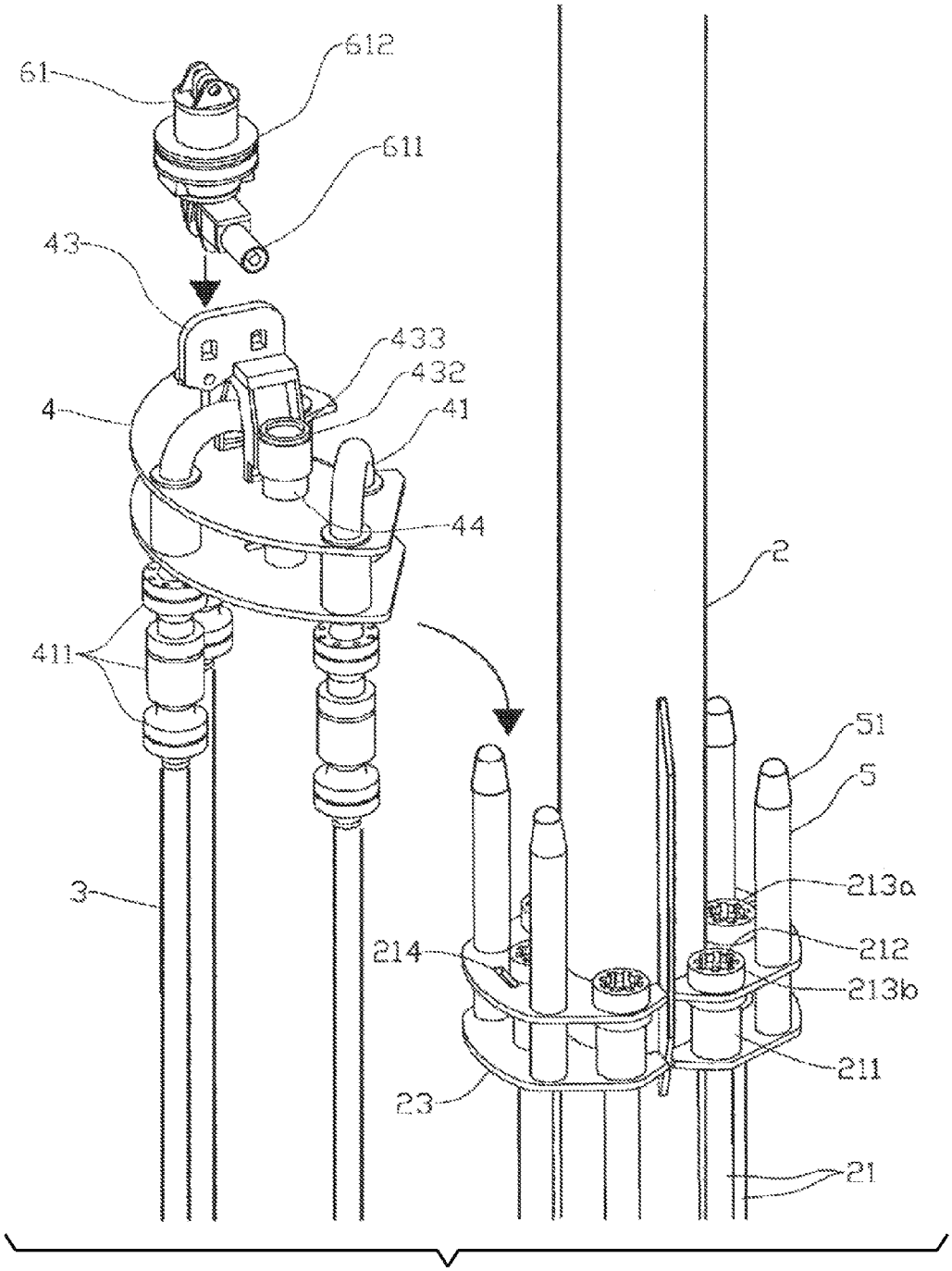
FIG. 2 shows in larger scale a perspective view of the arrangement according to the invention, in which a connecting assembly is about to be connected to fluid pipes secured to the riser.
Figure 3:
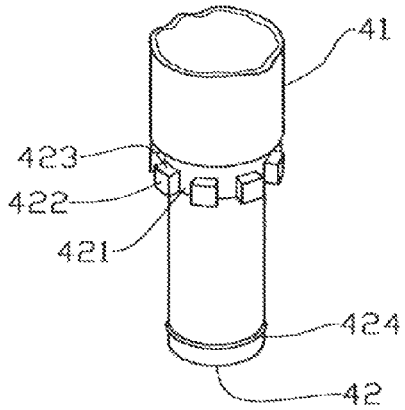
FIG. 3 shows in larger scale a pipe spool on the connecting assembly arranged for connection with a fluid pipe on the riser.
Figure 4:
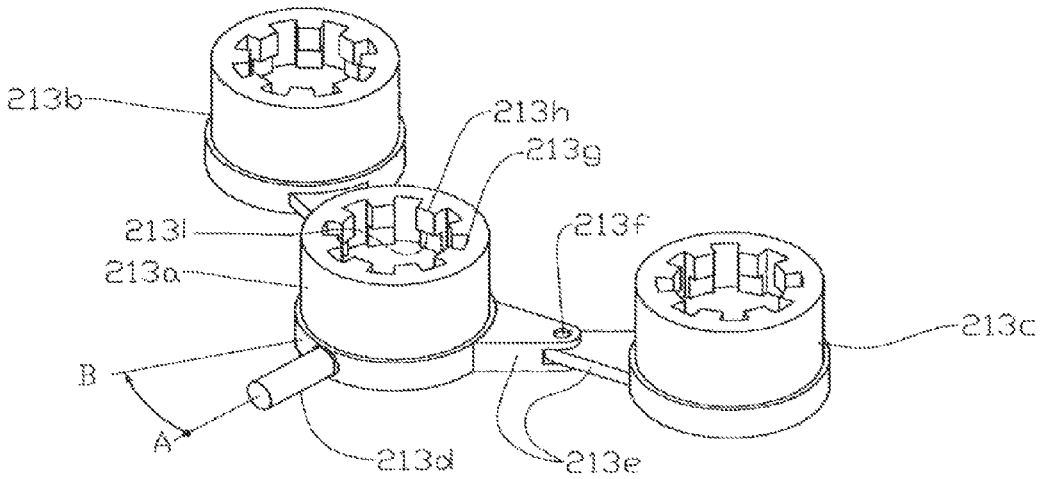
FIG. 4 shows three interconnected connecting sleeves arranged for receipt of the pipe spool shown in FIG. 3 and where one connecting sleeve is provided with a guide pin.
Figure 5:
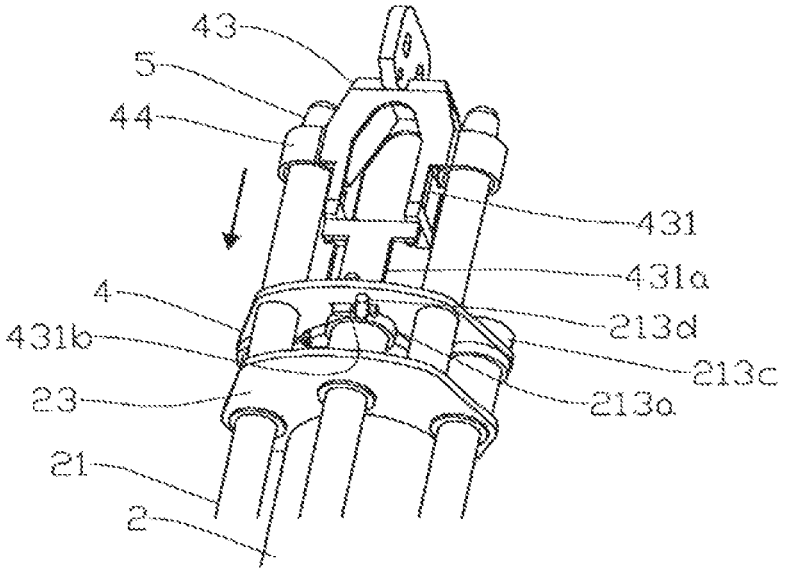
FIG. 5 shows an initial stage of the interconnection, where the connecting assembly, which for the sake of clarity is not shown, and the lifting yoke by means of guide pins is guided towards fluid pipes arranged on the riser, and an actuator is abutting against the guide pin on the one connecting sleeve.
Figure 6:
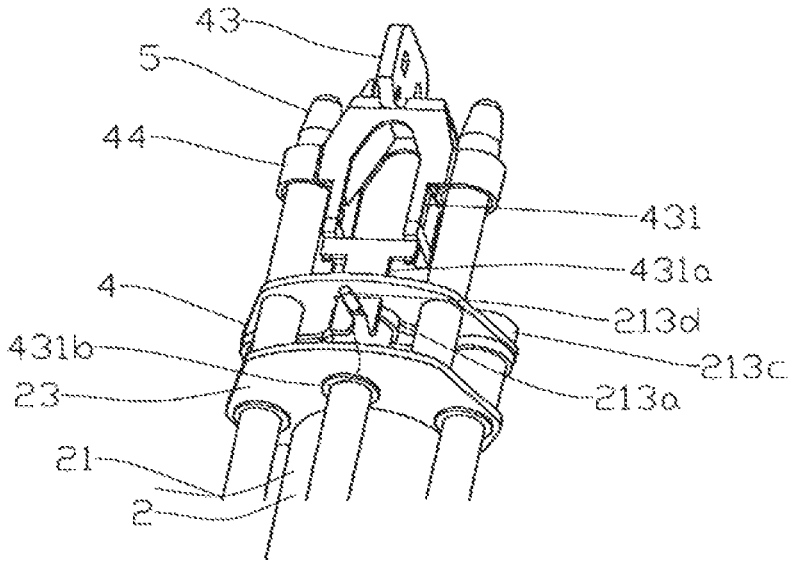
FIG. 6 shows the actuator displaced downwards in which it has caused that the connecting sleeves have been rotated until locked position (the connecting assembly is for the sake of clarity not shown).

The connecting assembly 4 and a lifting yoke 43 are connected to each other by means of several vertical, in an operative position, guides 432 having end stops 433 which provide a confined relative movement between the connecting assembly 4 and the lifting yoke 43 when the connecting assembly 4 is landed onto the riser 2 or being lifted up there from. The lifting yoke 43 thus forms a linear actuator 431 which is provided with a tongue 431*a* extending downwardly toward the guide pin 213*d* of the connecting sleeve 213*a* and is laterally stabilized by the side edges of a recess 214 (see FIG. 2) in close proximity to the first connecting sleeve 213*a*. A guide groove 431*b* is formed in the tongue 431*a* in such a way that the guide pin 213*d* can be guided along the groove 431*b*. By its inclined position in respect of the moving direction of the tongue 431*a*, the groove 431*b* causes the vertical motion of the lifting yoke 43 relative to the connecting assembly 4 to impart a rotating motion of the connecting sleeves 213*a*, 213*b*, 213*c* between an open position A and a locked position B.

The riser 2 is in immediate proximity to the first end part 211 of the fluid pipes 21 provided with several guide pins 5 arranged in parallel with the end parts 211 of the fluid pipes 21 and having a free end projecting upwardly. The guide pins 5 are provided with a conical end part 51.

The connecting assembly 4 is provided with a number of guiding sleeves 44 each being arranged for receipt of a guide pin 5, where the internal surface of the sleeve wall forms a guiding surface 441 (see FIG. 1). Some of the guiding sleeves 44 are provided with a guiding cone 442 in its lower end.

The lifting yoke 43 is connected to a manipulator 6 via a connecting device 61 provided with means 611 for remote controlled disconnection of the connecting assembly 4, and means 612 for rotation of the connecting assembly 4. The manipulator 6 is rotatable fixed to the floating installation 1 in immediate proximity to the riser 2 and is provided with a drive unit (not shown) and a control unit (not shown) for manipulation of the connecting assembly 4 with connected hoses 3 during connection and disconnection of the hoses 3 and the fluid pipes 21.

When the hoses 3 are to be connected to or from the fluid pipes 21 on the riser 2, the manipulator(s) 6 is operated to manipulate the connecting assembly 4 with the connected hoses 3 depending from the connecting assembly 4. During connection the connecting assembly 4 is lowered towards the end part 211 of the fluid pipes 21, the connecting assembly 4 is guided in that the guiding sleeves 44 enter the guide pins 5 and slide thereon. The connecting sleeves 213*a*, 213*b*, 213*c* remain rotated to open position A, and the pipe spools 41 can slide into their corresponding fluid pipes 21, the abutment surfaces 423 on the guide ridges 422 adopt a position at the arresting surfaces 213*i* of the connecting sleeves 213*a*, 213*b*, 213*c*. When the connecting assembly 4 rests on the riser 2, the lifting yoke 43 is moved by its own gravity and the one of the hose 3 down towards the connecting assembly 4 by sliding motion along the guides 432, and the tongue 431*a* engages its guide groove 431*b* about the guide pin 213*d* of the intermediate connecting sleeve 213*a* and, together with the articulated joint 213*e*, 213*f*, causes that all the connecting sleeves 213*a*, 213*b*, 213*c* are rotated to locked position B.

During disconnection, the manipulator(s) 6 causes that the lifting yoke 43 initially is vertically elevated from the connecting assembly 4 by guiding motion along the guides 432 until abutment against the end stops 433, where the tongue 431*a* during this motion rotates all the connecting sleeves 213*a*, 213*b*, 213*c* to open position A. When the lifting yoke hits the end stops 433, the connecting sleeves 213*a*, 213*b*, 213*c* are in open position A, and the pipe spools 41 can freely slide out of their corresponding fluid pipes 21 by continued elevation of the connecting assembly 4.

The invention claimed is:

1. An arrangement in a hose connection comprising:

a riser arranged between a wellhead and a floating surface installation, in which a hose forms a flexible fluid communicating connection between an upper portion of the riser and the floating surface installation;

a fluid pipe fixed to the riser and coupled to the hose via a connecting assembly including a rotatable connector having an inner member and an outer member, the inner member including external guide ridges and the outer member including internal guide grooves configured to receive the external guide ridges of the inner member when the inner member is inserted into the outer member, wherein the rotatable connector also includes a lever that extends radially outward with respect to the inner and outer members and enables rotation of the inner member and the outer member relative to one another through movement of the lever;

an actuator coupled to the connecting assembly and positioned to engage the lever to control rotational movement of the rotatable connector between a locked position and an unlocked position, wherein the actuator includes an element provided with a guide groove inclined relative to a central axis of the rotatable connector;

a lifting yoke coupled to the connecting assembly, wherein the lifting yoke includes the actuator and the lever includes a guide pin arranged for sliding motion in a longitudinal direction of the guide groove by vertical movement of the lifting yoke relative to the connecting assembly; and two additional rotatable connectors having inner and outer members, wherein the outer member of the rotatable connector is connected to the outer members of the two additional rotatable connectors to enable simultaneous and synchronized rotary motion of the rotatable connector with the additional rotatable connectors via engagement of the lever of the rotatable connector with the actuator.

2. The arrangement according to claim 1, wherein the guide pin by the inclination and longitudinal extension of the guide groove is arranged to be able to provide a rotating motion on the outer member of the rotatable connector from an open position and to a locked position relative to the inner member.

3. The arrangement according to claim 2, wherein the rotary motion of the outer member of the rotatable connector makes a sector of $360°/n \pm 2°$, where n is an even number.

4. The arrangement according to claim 3 wherein n is 16.

5. The arrangement according to claim 1, wherein the outer member of the rotatable connector is connected to the outer members of the two additional rotatable connectors via one or more parts projecting radially out from each of the outer members and interconnected by means of articulated joints and possibly an intermediate link.

6. An arrangement in a hose connection comprising:

a riser arranged between a wellhead and a floating surface installation, in which a hose forms a flexible fluid communicating connection between an upper portion of the riser and the floating surface installation;

a fluid pipe fixed to the riser and coupled to the hose via a connecting assembly including a rotatable connector having an inner member and an outer member, the inner member including external guide ridges and the outer member including internal guide grooves configured to receive the external guide ridges of the inner member when the inner member is inserted into the outer member, wherein the rotatable connector also includes a lever that extends radially outward with respect to the inner and outer members and enables rotation of the inner member and the outer member relative to one another through movement of the lever; and an actuator coupled to the connecting assembly and positioned to engage the lever to control rotational movement of the rotatable connector between a locked position and an unlocked position;

wherein the connecting assembly includes multiple rotatable connectors having inner and outer members to facilitate coupling of multiple hoses to multiple fluid pipes fixed to the riser.

7. The arrangement according to claim 6, wherein the multiple rotatable connectors are coupled to one another to enable synchronous rotation of the rotatable connectors between locked positions and unlocked positions via the lever.

8. An arrangement in a hose connection comprising:

a riser arranged between a wellhead and a floating surface installation, in which a hose forms a flexible fluid communicating connection between an upper portion of the riser and the floating surface installation;

a fluid pipe fixed to the riser and coupled to the hose via a connecting assembly including a rotatable connector having an inner member and an outer member, the inner member including external guide ridges and the outer member including internal guide grooves configured to receive the external guide ridges of the inner member when the inner member is inserted into the outer member, wherein the rotatable connector also includes a lever that extends radially outward with respect to the inner and outer members and enables rotation of the inner member and the outer member relative to one another through movement of the lever; and an actuator coupled to the connecting assembly and positioned to engage the lever to control rotational movement of the rotatable connector between a locked position and an unlocked position;

wherein the arrangement includes multiple connecting assemblies each including a rotatable connector having an inner member and an outer member, the inner member including external guide ridges and the outer member including internal guide grooves configured to receive the external guide ridges of the inner member when the inner member is inserted into the outer member.

* * * * *